US005453657A

United States Patent [19]

Park

[11] Patent Number: 5,453,657

[45] Date of Patent: Sep. 26, 1995

[54] INDIRECTLY-HEATED CATHODE HEATER STRUCTURE FOR A CATHODE RAY TUBE

[75] Inventor: Gong S. Park, Kumi-si, Rep. of Korea

[73] Assignee: Gold Star Co., Ltd., Seoul, Rep. of Korea

[21] Appl. No.: 299,245

[22] Filed: Aug. 31, 1994

Related U.S. Application Data

[63] Continuation of Ser. No. 871,275, Apr. 20, 1992, abandoned.

[30] Foreign Application Priority Data

Apr. 30, 1991 [KR] Rep. of Korea ..... 6092/1991

[51] Int. Cl.[6] ..... H01J 1/20; H01J 19/14; H01J 29/46

[52] U.S. Cl. ..... 313/337; 313/344; 313/446

[58] Field of Search ..... 313/337, 344, 313/446, 340, 343

[56] References Cited

U.S. PATENT DOCUMENTS

| | | | |
|---|---|---|---|
| 4,000,435 | 12/1976 | Jariwala | 313/446 |
| 4,825,119 | 4/1989 | Penelon | 313/344 |
| 5,164,631 | 11/1992 | Lee | 313/446 |
| 5,313,133 | 5/1994 | Park | 313/446 |

FOREIGN PATENT DOCUMENTS

| | | | |
|---|---|---|---|
| 2654554 | 6/1978 | Germany | 313/446 |
| 53-100868 | 8/1978 | Japan | 313/446 |
| 56-149741 | 11/1981 | Japan | 313/446 |
| 58-16431 | 1/1983 | Japan | 313/446 |

*Primary Examiner*—Sandra L. O'Shea
*Assistant Examiner*—Matthew J. Esserman
*Attorney, Agent, or Firm*—John P. White

[57] ABSTRACT

This invention relates to an indirectly-heated cathode heater structure comprising a heat generation section disposed inwardly of an upper portion of a sleeve for generating heat to emit thermions at an electron gun of a cathode ray tube, the heat generation section having a given calorific value being formed to have a length 25~33 % of the length of the sleeve, whereby heat loss at a lower portion of the sleeve during heating operation of the heater may be minimized, resulting in improving an overshoot rate of the heater.

3 Claims, 3 Drawing Sheets

INDIRECTLY-HEATED CATHODE HEATER STRUCTURE FOR A CATHODE RAY TUBE

This application is a continuation of U.S. Ser. No. 07/871,275 filed Apr. 20, 1992, now abandoned.

BACKGROUND OF THE INVENTION

1. Field of the Invention

This invention relates to an indirectly-heated cathode heater structure comprising a heat generation section for heating a cathode to emit thermions at an electron gun of a cathode ray tube.

2. Description of the Prior Art

Generally, a cathode body having a cathode heater (hereinafter referred to as a "heater" for brevity) mounted therein, and used in an electron gun of a cathode ray tube is of the type as shown in FIG. 1 of the accompanying drawings, which broadly comprises a cathode cap 2 having electron emission material 1 made of carbonate, and a sleeve 4 being a hollow body made of Ni—Cr alloy surrounding the heater 3. When a rated voltage is applied to the heater 3 of the electron gun, the temperature of a heat generation section of the heater 3 is raised to a given temperature in the range of about 780°–820° C. in 4 to 6 seconds. This heat is transferred to the sleeve 4 and the cathode cap 2 of the cathode body. Therefore, in order for the heater to have the given calorific value necessary for emitting the thermions of a predetermined density, the heater needs to have a calorific wire 5 and arrangement structure suitable for efficient heat generation.

The prior art heater used in the electron gun comprises, as shown in FIG. 1, the heat generation section 3*a* positioned inwardly of the upper portion of the sleeve 4, a power input section 3*b* positioned inwardly of the lower portion of the sleeve, and a fixing section 3*c*. In such a heater, to enhance the thermal efficiency of the heat generation section 3*a* to have the given calorific value, the heat generation section has a double wound structure and is disposed within the upper portion of the sleeve 4 over a length approximately 45% of the overall length L of the sleeve.

However, since the length of the heat generation section of the heater according the the prior art is unnecessarily longer than a desired length, considerable heat is lost at the lower portion of the sleeve. As a result, in an initial state just after application of voltage to the heater, the heater has an initial current which overshoots the reference current. This overshoot rate ranges from a minimum of 133% to a maximum of 157% of the reference current. This rate considerably deviates from the reference cathode current variation in the range of 100~120%, which corresponds to the overshoot rate allowable in the actual design. The term "overshoot" as referred to herein means an initial cathode current variation when the heater of the cathode ray tube has been initially energized, and "overshoot rate" means the percentage of the initial cathode current value relative to the reference cathode current value.

The graph of FIG. 2 shows the measurements of the initial cathode current values in the heater structure of the prior art shown in FIG. 1. Assuming for "R" that the value of Ik is 31.3 μA ( the initial current, $IK_1$, max.) and the value of Is the reference current, $IK_0$) is 20 μA, the overshoot rate is expressed as the following:

$$\text{Overshoot rate} = \frac{31.3}{20} \times 100 = 157\%$$

And, for "B": assuming that Ik is 26.5 μA (the initial current, $IK_1$, min.) and Is is 20 μA, the overshoot rate is expressed as:

$$\text{Overshoot rate} = \frac{26.5}{20} \times 100 = 133\%$$

The reason for taking a serious view of the overshoot rate is that a higher overshoot rate results in an increased initial cathode current variation, thereby leading to change in the brightness on the screen of the cathode ray tube.

SUMMARY OF THE INVENTION

In view of the aforesaid problem of the prior art, it is an object of the present invention to provide an indirectly-heated cathode heater structure for a cathode ray tube, which can provide a reduced overshoot rate by adjusting the length of a heat generation section of the heater.

To achieve the above object, there is provided according to one form of the present invention an indirectly-heated cathode heater structure for a cathode ray tube, comprising a heat generation section disposed inwardly of an upper portion of a cathode sleeve for generating heat to emit thermious from thermion emission material on top of the sleeve; a power input section provided at a lower portion of the heat generation section to supply electric power to the section; and a fixing section for securing the heat generation and power input sections to the cathode sleeve.

DESCRIPTION OF THE PREFERRED EMBODIMENT

The invention will now be described in more detail with reference to FIGS. 3 and 4 of the accompanying drawings which show preferred embodiments thereof.

The general construction and operation of a cathode body according to the present invention comprises a cathode cap 2 having carbonate thermion emission material 1, and a sleeve 4 made of Ni—Cr alloy surrounding a heater which is identical with those in the prior art as discussed above, with the exception of the structure of the heater.

Figure 1:
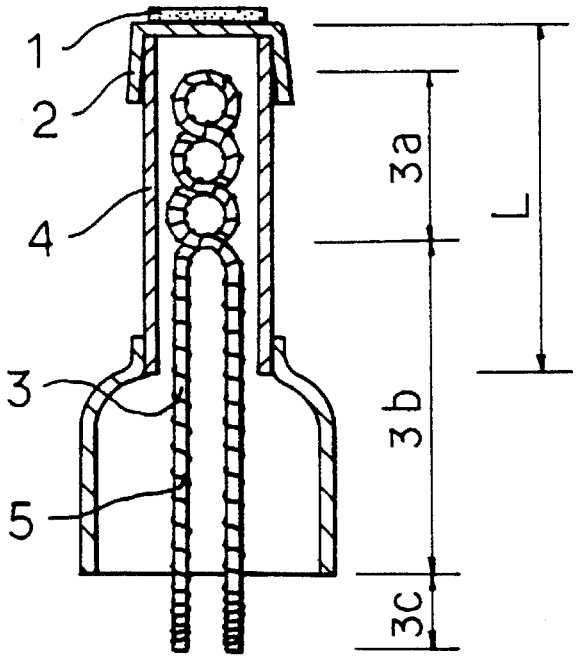
FIG. 1 PRIOR ART
FIG. 1 is a cross-sectional view of a cathode body having a heater of the prior art mounted therein.
Figure 2:
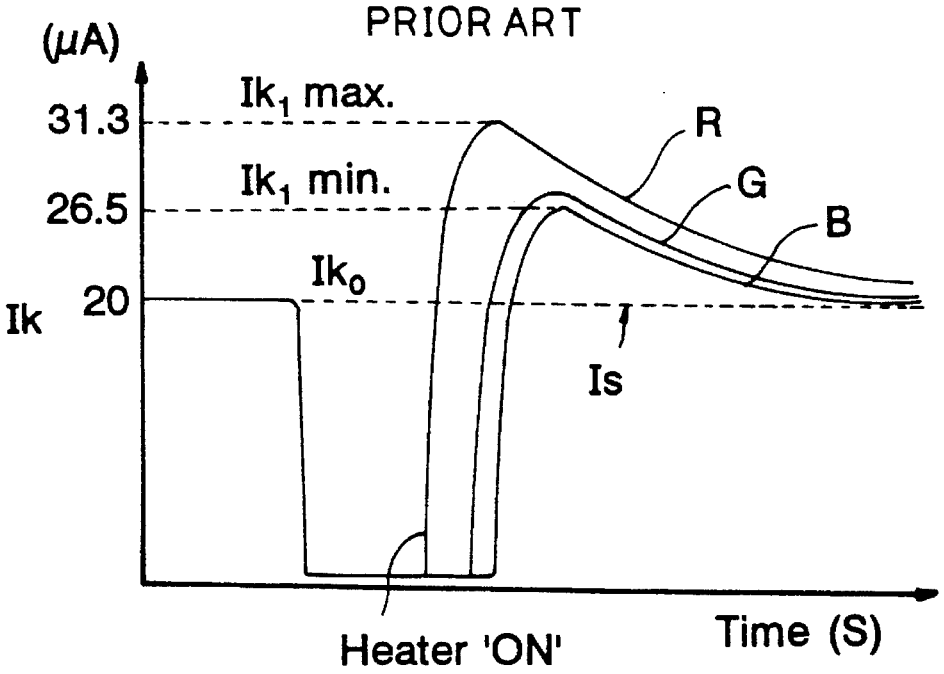
FIG. 2 PRIOR ART
FIG. 2 is a graph for showing the overshoot rate of the prior art.
Figure 3:
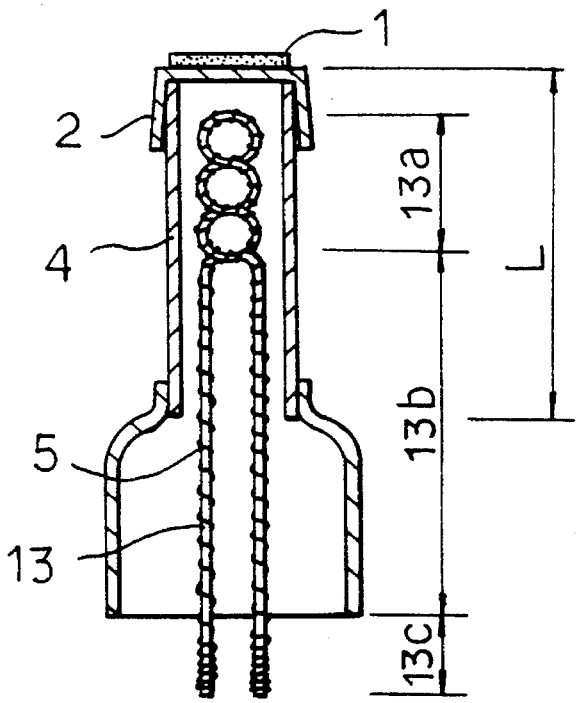
FIG. 3 is a cross-sectional view of a cathode body having a heater according to one embodiment of the present invention.

Referring to FIG. 3 which shows the cathode body according to one embodiment of the present invention, a heat generation section 13*a* of the heater 13, is positioned inwardly of an upper portion of the sleeve 4 and is formed to have a length 25–30% of the overall length L of the sleeve by reducing the diameter of each of its twisted portions, so that heat may be localized upon the upper portion of the sleeve. Also, to enable the heat generation section 13*a* to have a given calorific value necessary for emitting thermions of a predetermined density, a wound calorific wire of the heat generation section is arranged to have the same distance between turns as that in the prior art. In FIG. 3, numerals 13*b* and 13*c* indicate power input and fixing sections, respectively.

In operation, when the rated voltage is applied to the heater 13, the heater reaches a predetermined temperature of 780°~820° C., thereby transferring heat to the cathode cap 2 and sleeve 4 disposed around the heater. Since the heat generation section 13*a* of the heater has a shortened length, 25~33% of the length L of the sleeve as compared with 45% in the prior art, a transfer of the heat to the lower portion of the sleeve during the heating operation of the heater is considerably reduced, and the heat is concentrated on the upper portion of the sleeve. As a result, heat loss at the lower portion of the sleeve may be reduced, whereby the carbonate electron emission material 1 on the top of the sleeve may be heated effectively to emit the thermions of the predetermined density.

Figure 5:
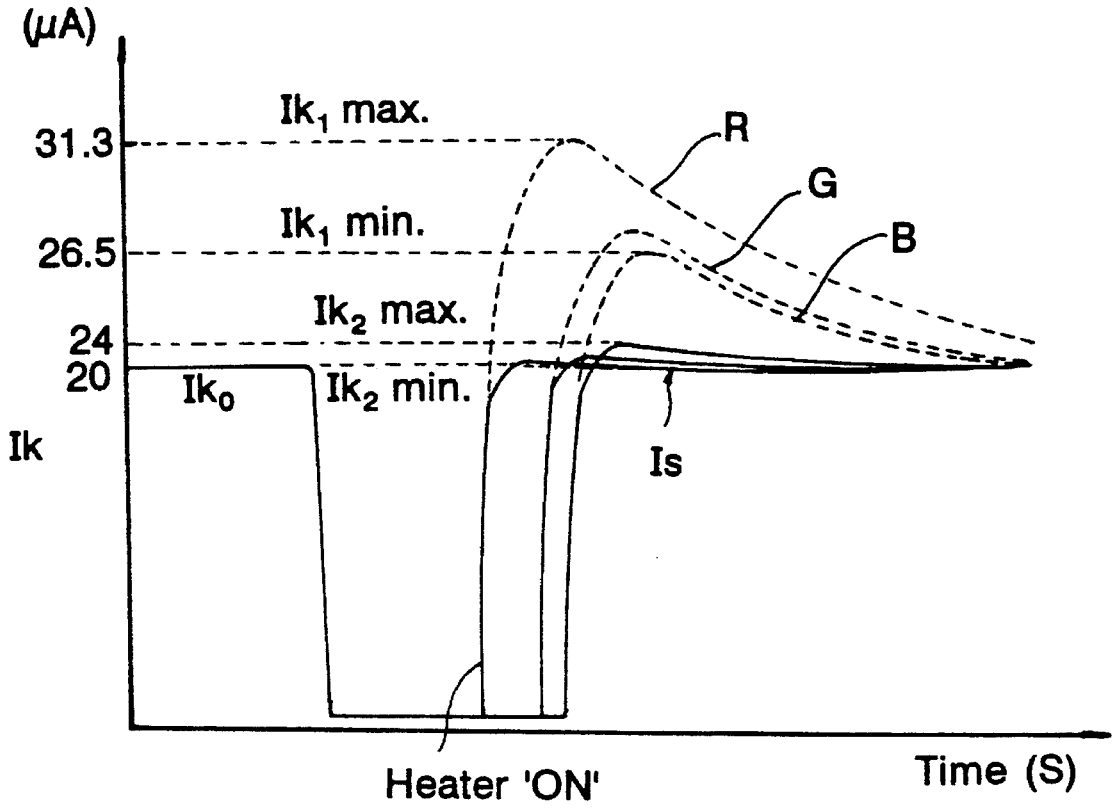
FIG. 5 is a graph showing the overshoot rate of the heater of the present invention as compared with the overshoot rate in the prior art.

With the construction as set forth above, since the heater maintains the given calorific value necessary for emitting the thermions of the predetermined density, the heater according to one embodiment of the present invention has the initial cathode current value in the range of $Ik_2$, min. of 20 μA to $Ik_2$, max. of 24 μA, as indicated by the solid lines in FIG. 5. Therefore, from the overshoot equations mentioned above, a minimum value of the overshoot rate is 100%, and a maximum value of the overshoot rate is 120%. That is, the heater of the present invention has the improved overshoot rate of 100~120%, which is a value reduced by 33~37% from the overshoot rate of 133~157% in the prior art and which approaches the allowable reference cathode current variation. In FIG. 5, the curves as indicated by the solid allowable lines represents the improved overshoot rate according to the present invention, while the curves indicated by the dotted lines represents the overshoot rate in the prior art.

Figure 4:
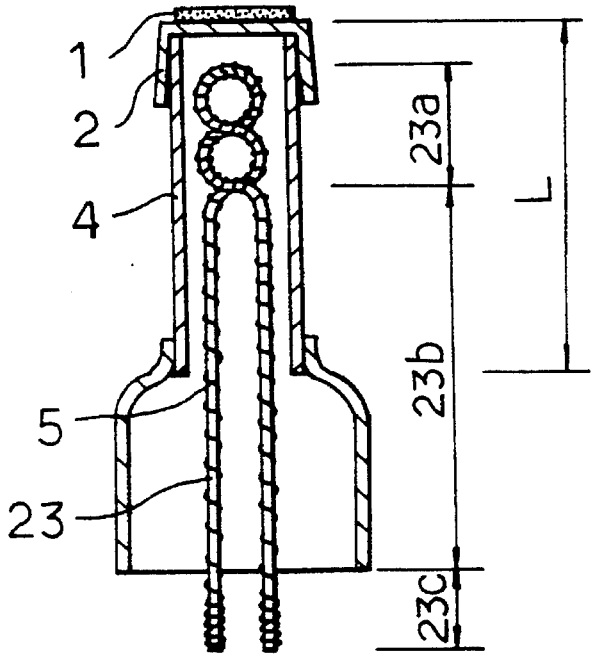
FIG. 4 is a cross-sectional view of a cathode body having a heater according to another embodiment of the present invention.

Referring now to FIG. 4 which shows the cathode body according to another embodiment of the present invention, the general construction of the cathode body of this embodiment is the same as that of the previous embodiment with the exception that a heat generation section 23*a* of a heater 23 of this embodiment is formed to have a length 25~33% of the length L of the sleeve 4 by reducing the number of the twisted portions. Each of these twisted portions of the heat generation section 23*a* has the same diameter as that of the twisted portion in the prior art, while the number of turns of the wound calorific wire of the section is increased over the number of turns of the calorific wire 5 of the heat generation section 3*a* according to the prior art. As a result, the heat generation section 23*a* may maintain the given calorific value per unit length required for emitting the thermions of the predetermined density. The operation of this embodiment is identical with that of the previous embodiment, and thus is not further described. In FIG. 4, numerals 23*b* and 23*c* indicate power input and fixing sections, respectively.

As discussed above, the present invention provides advantages over the prior art in that since the heat generation section of the heater disposed inwardly of the upper portion of the sleeve has a shortened length, heat loss at the lower portion of the sleeve during heating operation of the heater may be minimized, resulting in enhanced thermal efficiency. Since the heat generation section has sufficient calorific value to efficiently emit the thermions, the overshoot rate does not become high, but is maintained at a level approaching the allowed reference cathode current variation, whereby a lowering of the quality of the products, such as a change in brightness on the screen, may be prevented.

While the invention has been shown and described with particular reference to preferred embodiments thereof, it will be understood that variations and modifications in detail may be made therein without departing from the spirit and scope of the invention as defined in the appended claims.

What is claimed is;

1. An indirectly-heated cathode heater structure for a cathode ray tube, comprising:

a cathode sleeve having an overall length;

a heat generation section disposed inwardly of an upper portion of said cathode sleeve for generating heat to emit thermions from thermion emission material positioned proximate a top end of said cathode sleeve, said heat generation section formed to have a length 25~33% of said overall length of said cathode sleeve;

a power input section provided at a lower portion of said heat generation section to supply electric power to said heat generation section; and a wound calorific wire having a number of turns positioned in said heat generation section and said power input section, such that a distance between each turn of said wound calorific wire in said heat generation section is shorter than a distance between each turn of said wound calorific wire in said power input section.

2. An indirectly-heated cathode heater structure for a cathode ray tube as claimed in claim 1, wherein said heat generation section comprises:

three twisted portions.

3. An indirectly-heated cathode heater structure for a cathode ray tube as claimed in claim 1, wherein said heat generation section comprises:

two twisted portions.

* * * * *